US009505052B2

(12) United States Patent
Truelle et al.

(10) Patent No.: US 9,505,052 B2
(45) Date of Patent: Nov. 29, 2016

(54) TOOL FOR MANUFACTURING A FOUNDRY CORE FOR A TURBINE ENGINE BLADE

(71) Applicant: SNECMA, Paris (FR)

(72) Inventors: Franck Edmond Maurice Truelle, Argenteuil (FR); Christian Bariaud, Orsay (FR); Philippe Bouthemy, Issy les Moulineaux (FR); Patrick Pourfilet, Asnieres sur Seine (FR); Jean-Louis Martial Verger; Alain Grandin, Asnieres sur Seine (FR); Daniel Quach, Fontenay sous Bois (FR)

(73) Assignee: SNECMA, Paris (FR)

( * ) Notice: Subject to any disclaimer, the term of this patent is extended or adjusted under 35 U.S.C. 154(b) by 13 days.

(21) Appl. No.: 14/400,457

(22) PCT Filed: May 7, 2013

(86) PCT No.: PCT/FR2013/051028

§ 371 (c)(1),
(2) Date: Nov. 11, 2014

(87) PCT Pub. No.: WO2013/167847

PCT Pub. Date: Nov. 14, 2013

(65) Prior Publication Data

US 2015/0122445 A1 May 7, 2015

(30) Foreign Application Priority Data

May 11, 2012 (FR) ..... 12 54350
Sep. 5, 2012 (FR) ..... 12 58282

(51) Int. Cl.

| | |
|---|---|
| ***B22C 13/12*** | (2006.01) |
| ***B22C 9/10*** | (2006.01) |
| ***F01D 5/20*** | (2006.01) |
| ***B22C 21/14*** | (2006.01) |
| ***B22C 9/18*** | (2006.01) |
| ***B22C 9/24*** | (2006.01) |
| ***F01D 5/18*** | (2006.01) |

(52) U.S. Cl.

CPC ..... *B22C 13/12* (2013.01); *B22C 9/10* (2013.01); *B22C 9/103* (2013.01); *B22C 9/18* (2013.01); *B22C 9/24* (2013.01); *B22C 21/14* (2013.01); *F01D 5/18* (2013.01); *F01D 5/20* (2013.01); *F05D 2230/21* (2013.01)

(58) Field of Classification Search

CPC ..... B22C 9/103; B22C 9/18; B22C 9/24; B22C 9/10; B22C 21/14; B22C 13/12

See application file for complete search history.

(56) References Cited

U.S. PATENT DOCUMENTS

| | | | |
|---|---|---|---|
| 5,599,166 | A | 2/1997 | Deptowicz et al. |
| 2007/0025851 | A1 | 2/2007 | Guerche et al. |

FOREIGN PATENT DOCUMENTS

| | | |
|---|---|---|
| EP | 1 754 555 | 2/2007 |
| FR | 2 957 828 | 9/2011 |

OTHER PUBLICATIONS

International Search Report Issued Apr. 10, 2014 in PCT/FR13/051028 Filed May 7, 2013.

*Primary Examiner* — Kevin P Kerns
*Assistant Examiner* — Steven Ha
(74) *Attorney, Agent, or Firm* — Oblon, McClelland, Maier & Neustadt, L.L.P.

(57) ABSTRACT

A tooling for fabricating a foundry core, for making a circuit for cooling a blade of a turbine engine, the tooling including: a mold for injecting a paste and including imprints for a first portion and a second portion of the core; a mechanism bearing against and/or engaging end portions of a ceramic rod that interconnects the portions of the core and that passes through the imprint for the first portion of the core; and a support mechanism in the imprint for the first portion of the core to support a substantially middle portion of the rod.

19 Claims, 5 Drawing Sheets

TOOL FOR MANUFACTURING A FOUNDRY CORE FOR A TURBINE ENGINE BLADE

BACKGROUND OF THE INVENTION

Field of the Invention

The present invention relates to tooling for fabricating a foundry core for making a cooling circuit in a turbine engine blade.

Description of the Related Art

A turbine engine blade, and in particular a blade for a turbine wheel of a turbine engine, includes a cooling circuit that is fed with air via orifices formed in the blade root, these orifices opening out into internal cavities of the blade that communicate with a bathtub at the tip of the airfoil of the blade. The bathtub is formed by a recess at the tip of the blade, being separated from internal cavities in the blade by a bathtub bottom wall, and it is in fluid flow communication with the internal cavities via orifices passing through said bottom wall. In operation, air penetrates into the orifices in the blade root, flows along the internal cavities in the blade, and is then expelled, in part into the bathtub via the above-mentioned orifices, and in part into the annular passage through the turbine via air outlet orifices in the airfoil of the blade.

The cooling circuit of a blade of this type includes in particular the bathtub, the internal cavities in the blade, and the orifices in the bathtub bottom wall that provide fluid flow communication between the bathtub and the internal cavities.

This cooling circuit is complex in shape and it is generally obtained by means of a foundry core that is inserted in a mold into which a molten metal is cast in order to make the blade.

Documents EP-A1-1 661 642, EP-B1-1 754 555 and EP-A1-1 980 343 describe cores of this type.

The core is generally made from a paste comprising ceramic fillers and a polymer-based binder, which paste is injected into a mold of tooling and is then heated in order to solidify the core.

In the prior art, the mold of the tooling includes imprints for a first portion of the core that is to form the bathtub of the blade, and for one or more other portions imprint that are to form one or more respective internal cavities of the blade.

The mold includes a wall separating the first portion of the imprint from the or the other portions of the core, this wall serving to define a space in the core between its first portion and its other portions. During fabrication of the blade, molten metal penetrates into this space in the core in order to form of the above-mentioned bathtub bottom wall of the blade.

As explained above, this bathtub bottom wall is pierced by orifices. These orifices are obtained in casting by means of ceramic rods that are positioned in the mold, prior to fabricating the core, and that form integral portions of the core after it has been fabricated.

Each ceramic rod generally connects the first portion of the core to one of the above-mentioned other portions (EP-B1-1 754 555).

In the prior art, the mold for fabricating the core includes means for bearing against and/or embedding end portions of each rod. One of those means is formed on the above-mentioned wall of the mold, and the other means is formed on another portion of the mold, that is opposite from the above-mentioned wall relative to the imprint for the first portion of the core. Each rod thus passes through the imprint of the first portion of the mold.

In particular, the diameter of the orifices in the bathtub bottom wall is a function of the diameter of the ceramic rods of the core. To reduce the diameter of these orifices, it is possible to reduce the diameter of the rods. Nevertheless, it has been found that rods of small diameter (e.g. of about 0.6 millimeters (mm)) are relatively fragile and frequently break while the paste is being injected into the mold, thereby causing the core to be scrapped.

BRIEF SUMMARY OF THE INVENTION

A particular object of the present invention is to provide a solution to this problem that is simple, effective, and inexpensive.

To this end, the invention provides tooling for fabricating a foundry core for making a cooling circuit in a turbine engine blade, the core comprising a first portion for defining a bathtub of the blade and at least one other portion for defining an internal cavity in the blade, and at least one rod that extends between the first portion and the or each other portion and that is to define means for passing fluid between the bathtub and the corresponding internal cavity in the blade, the tooling comprising a mold for injecting a paste and having imprints for the first portion and for the or each other portion of the core, and means for bearing against and/or embedding end portions of the or each rod, one of these means being formed in a wall of the mold between the imprint for the first portion of the core and the imprint for the or each other portion of the core, the tooling being characterized in that it includes support means in the imprint for the first portion of the core to support a substantially middle portion of the or each rod.

The imprint can take a number of different forms, including for example a depression, a cavity, a recess, or other feature for receiving the paste.

According to the invention, the middle portion of the or each rod, which is the portion of the rod that is most subjected to buckling while the paste is being injected into the mold, is supported by means for holding the or each rod in position so as to prevent them from deforming and breaking under the effect of the forces applied while injecting the paste. The invention makes it possible to make a foundry core for a turbine engine blade in which the rod(s) is/are of relatively small diameter, less than 0.8 mm, e.g. about 0.6 mm.

The support means for supporting a rod are independent of the support means for supporting other rods. The means for supporting the rods may be spaced apart from one another and the means for supporting a rod may be situated halfway from the bearing and/or engagement means for the rod.

By way of example, the support means comprise at least one projecting member projecting from the bottom of the imprint for the first portion of the core, this member being substantially semi-ovoid in shape, for example.

The or each member may include a notch in its tip for receiving the middle portion of a rod.

The notch may be of section that is substantially L-shaped, preferably having two plane intersecting faces that are to be substantially parallel to the longitudinal axis of the corresponding rod. The rod is to bear against each of the faces via a bearing line that is substantially parallel to the axis of the rod.

The notch may also have a section that is substantially U-shaped or C-shaped, comprising two plane lateral faces that are substantially parallel to each other and to the longitudinal axis of the corresponding rod.

When the notch is substantially L-shaped, it has been found during injection of the paste into the tooling that the paste can exert a lateral force on the rod, which can then move and break. This applies in particular when the paste exerts a force on the rod that is directed from the side where the rod is not completely supported by its support member.

Thus, the U-shaped or C-shaped section of the notch in each member receives the middle portion of the rod, which is thus supported on both sides by the member. When the paste injected into the tooling exerts lateral forces on the rod, the rod is held in position by the member and cannot be moved or broken. This particular U-shaped or C-shaped section provides better support than the L-shaped section.

Each of the side faces of the notch is connected to a top face of the member via a convex rounded edge, in particular to facilitate inserting the rod into the notch.

The rod is thus caused to bear against each of these lateral faces via a respective bearing line that is substantially parallel to the axis of the rod. In a variant, in the assembled position, the rod may be at a small distance (less than 0.1 mm) from one of the faces or from both of them.

One of the faces of the notch may be substantially perpendicular to the direction in which the paste is injected into the mold, and in particular in its imprint for the first portion of the core. During injection of the paste into the mold, the rod bears against this face that opposes the flow stream of the paste and that ensures that the rod is well held in position.

When the rod has a section that is U-shaped or C-shaped, the side faces may be substantially perpendicular to a direction in which the paste is injected into the mold so that during injection of the paste into the mold, the rod bears against these faces that oppose the flow stream of the paste and that ensure that the rod is well held in position.

The or each member may be formed integrally with the mold or it may be separate and fastened to the mold.

The tooling may also include a countermold that likewise includes support means for supporting a middle portion of the or each rod.

Advantageously, the tooling of the invention includes a countermold that includes means for preventing the or each rod from moving in the notch of the corresponding member, these means including at least one spacer formed projecting into a imprint of the countermold and including at its tip a finger for engaging in the top portion of the notch and/or for bearing against the portion of the rod received in that notch.

When the mold and the countermold are in the assembled position, the or each spacer is to occupy a position facing the corresponding member to prevent the rod from leaving the notch in the member, in particular while the paste is being injected into the tooling and is exerting a force on the rod tending to dislodge it from the notch (e.g. an upwardly directed force). The rod is then held in position by a member and by a spacer that together prevent any movement of the rod in a plane perpendicular to the longitudinal axis, thereby limiting any risk of the rod breaking.

The or each spacer preferably includes means for bearing against and positioning the top of the corresponding member.

The countermold may include a number of spacers that is smaller than the number of members of the mold, such that only some of the members of the mold are associated with spacers of the countermold.

The support means may include at least three or four projecting members. The countermold may include a single spacer for co-operating, in the assembled position, with a member of the mold situated beside the trailing edge of the core that is to be made.

The present invention also provides a method of fabricating a foundry core by means of tooling as described above, the method comprising steps of injecting a paste including ceramic fillers into the tooling, and of solidifying and extracting the core, the method being characterized in that it includes an additional step, after extracting the core, consisting in filling in the or each recess in the core defined by the tooling support means, e.g. with a ceramic material.

The core made by means of the tooling of the invention presents at least one small setback or recess in its first portion for defining the bathtub of the blade, because of the presence of the support means in the mold. This recess is easily filled in with a material similar to that of the core.

BRIEF DESCRIPTION OF THE SEVERAL VIEWS OF THE DRAWINGS

The invention can be better understood and other characteristics, details and advantages thereof appear more clearly on reading the following description made by way of nonlimiting example and with reference to the accompanying drawings, in which.

DETAILED DESCRIPTION OF THE INVENTION

Figure 1:
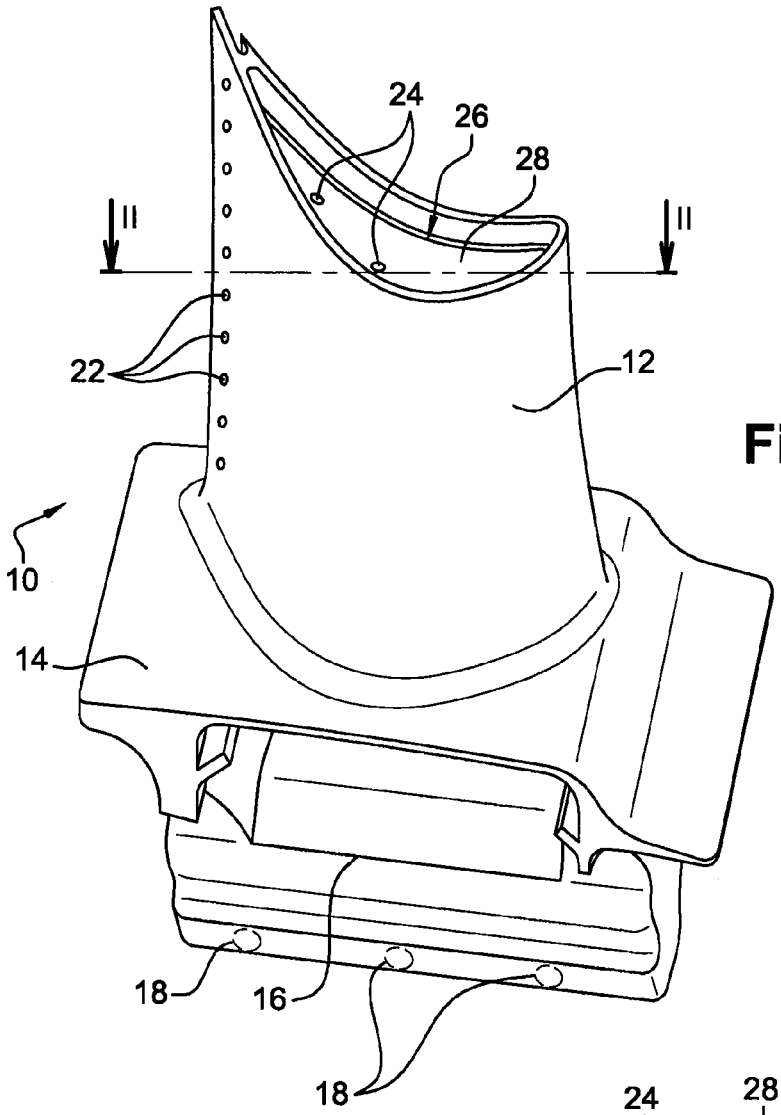
FIG. 1 is a diagrammatic perspective view of a rotor blade of a turbine engine.

Reference is made initially to FIG. 1 that shows a rotor blade 10 of a turbine-engine compressor or turbine, the rotor blade comprising an airfoil 12 connected by a platform 14 to a root 16.

Figure 2:
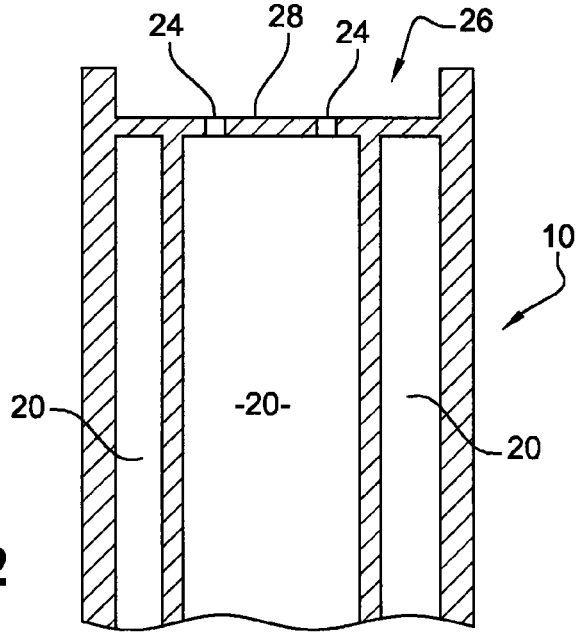
FIG. 2 is a diagrammatic view in section on line II-II of FIG. 1 and shows a circuit for cooling the blade.

The blade 10 includes an internal cooling circuit that can be seen in part in FIG. 2, the circuit being fed with air via orifices 18 in the blade root 16. These orifices open out into internal cavities 20 of the blade in which the blade cooling air flows. This air is then expelled via orifices 22 in the trailing edge of the airfoil 12 and via orifices 24 in the tip of the airfoil.

The orifices 24 in the tip of the airfoil open out into a bathtub 26 that is formed by a set back in the tip of the airfoil 12 and that is separated from the internal cavities 20 by a bottom of bathtub wall 28, in which the above-mentioned orifices 24 are formed.

The cooling circuit of the blade 10 is obtained in the casting by means of a core that is assembled in the ceramic shell mold into which a molten metal alloy is cast. After solidification and extraction of the blade, the core is eliminated, e.g. by chemical attack.

Figure 3:
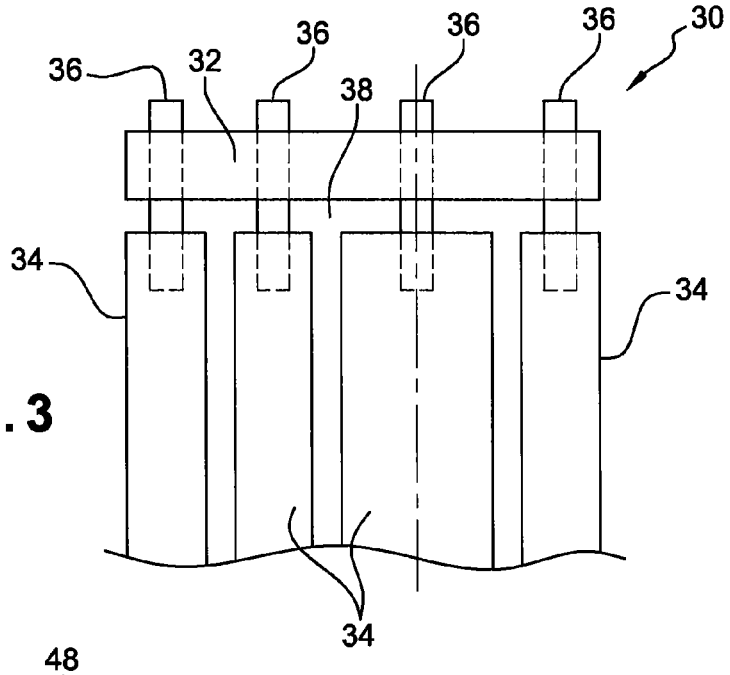
FIG. 3 is a very diagrammatic view of a foundry core for making a turbine engine blade.

FIG. 3 shows in highly diagrammatic manner a core 30 of this type, the core 30 comprising a first portion 32 for forming the bathtub 26 of the blade, other portions 34 for forming the respective internal cavities 20 of the blade, and ceramic rods 36, each connecting the first portion 32 to one of the other portions 34.

The first portion 32 of the core 30 is of shape and dimensions complementary to the shape and dimensions of the bathtub 26 that is to be formed, and the other portions 34 are likewise of shapes and dimensions complementary to the shapes and dimensions of the cavities 20 that are to be formed.

The ceramic rods 36 perform two functions: mechanically interconnecting the various portions of the core 30; and holding these portions in predetermined positions and at predetermined spacings. As can be seen in FIG. 3, the first portion 32 of the core is separated from the other portions 34 by a space 38 of thickness that depends on the length of the rod portions 36 extending between the first portion and the other portions of the core.

While casting the molten alloy into the ceramic shell mold, a portion of the alloy needs to penetrate into the space 38 of the core 30 in order to form the bottom wall 28 of the bathtub, which is of thickness that is determined by the thickness of the space 38.

The ceramic rods 36 of the core 30 are for forming the orifices 24 in the wall 28 that provide fluid flow communication between the bathtub 26 and the internal cavities 20 of the blade. In particular, the diameter of these orifices 24 is a function of the diameter of the ceramic rods 36 of the core 30.

The ceramic rods 36 are assembled in the mold of the core fabrication tooling prior to injecting the paste into the mold. In the prior art, the mold comprises a first imprint for the first portion 32 and a second imprint for the other portions 34 of the core 30, these imprints being separated from each other by a wall that is to form the above-mentioned space 38 of the core.

The ceramic rods 36 are assembled in the mold so that they pass in full through the first imprint, an end portion of each rod being embedded in a socket in the mold, and the opposite end portion of the rod extending into the second imprint of the mold and bearing against the above-mentioned wall of the mold.

As explained above, it has been found that the ceramic rods 36, in particular those of small diameter (e.g. of the order of 0.6 mm), tend to break while the paste is being injected into the mold, thereby requiring the core to be scrapped.

The present invention provides a solution to that problem by means for supporting the middle portions of the ceramic rods assembled in the mold of the tooling.

Figure 4:
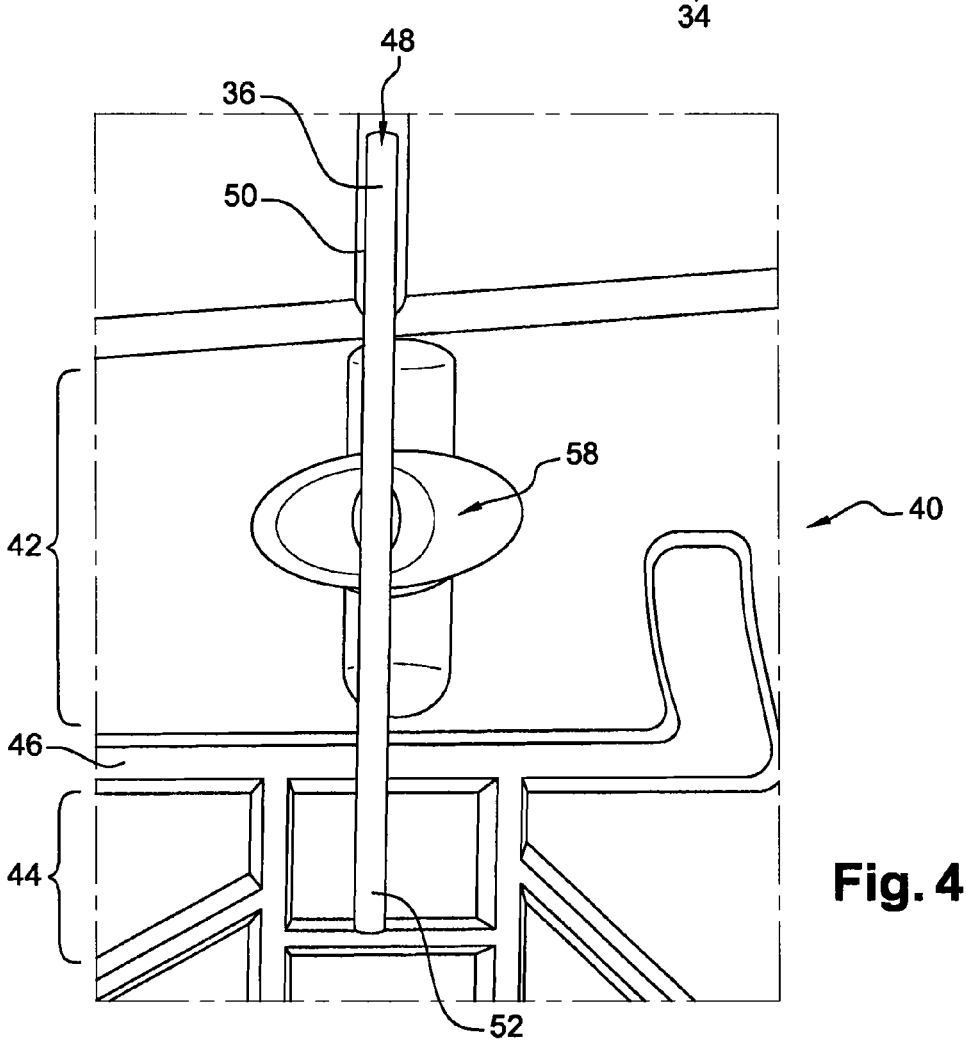
FIGS. 4 and 5 are fragmentary diagrammatic views in perspective of the tooling of the invention for fabricating a foundry core by molding, the tooling carrying a ceramic rod of the core.
Figure 5:
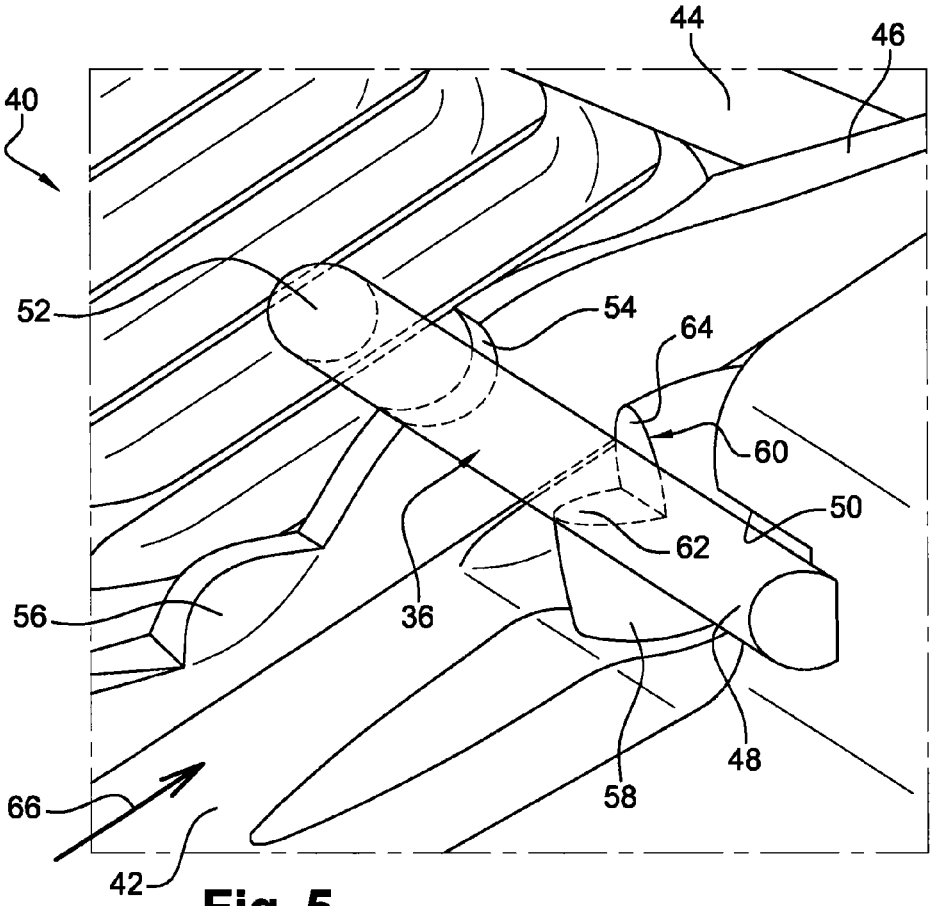

FIGS. 4 and 5 show an embodiment of the tooling of the invention, the tooling comprising a mold 40 having a first imprint 42 for the first portion 32 of the core 30 and a second imprint 44 for the other portions 34 of the core, these imprints 42, 44 being separated from each other by a wall 46 that is to form at least a portion of the above-mentioned space 38 of the core.

A single ceramic rod 36 is shown in FIGS. 4 and 5, this rod having an end portion 48 embedded in a socket 50 of the mold and an opposite end portion 52 extending into the second imprint 44 of the mold and bearing against the wall 46 of the mold.

The wall 46 of the mold includes a notch 54 of U-shaped C-shaped section that is substantially complementary to the section of a portion of the rod 36, which rod is substantially cylindrical in the example shown. The socket 50 in the mold 40 is likewise substantially complementary in shape to the shape of a rod 36. This prevents the paste passing between the rod 36 and the walls of the notch 54 and of the socket 50, while the paste is being injected into the mold 40.

The tooling of the invention may include a countermold, (not shown) that likewise comprises a first imprint for the first portion 32 of the core 30 and a second imprint for the other portions 34 of the core, these imprints being separated from each other by a wall that is to form the above-mentioned space 38 of the core. This wall of the countermold has a free edge of shape complementary to the shape of the free edge of the wall 46 of the mold, such that these walls are in alignment with each other and engage one in the other when the tooling is assembled. As can be seen in FIG. 5, the wall 46 may include projecting means 56 for cooperating by interconnecting shapes with complementary means of the wall of the countermold in order to ensure that the walls are properly positioned on assembly.

As can be seen in FIGS. 4 and 5, the middle portion of the rod 36 extends through the first imprint 42 of the mold 40. According to the invention, support means 58 are provided in this imprint 42 for supporting the middle portion of the rod 36 and for holding it in position in order to limit any deformation thereof while the paste is being injected into the mold.

In the example shown, the support means of the rod comprise a projecting member 58 projecting from the bottom of the first imprint 42 of the mold, this member being situated substantially halfway between the socket 50 and the notch 54 of the mold.

This member 58 may be separate and fastened to the mold 40, as in the example shown, or else it may be formed integrally with the mold. It may be made of the same material as the mold, i.e. of metal alloy.

In this example, the member 58 is of semi-ovoid shape and at its top it presents a notch 60 for engaging the rod 36. As can be seen in FIG. 5, this notch is of L-shaped section and has two main and intersecting faces 62 and 64 that extend substantially parallel to the longitudinal axis of the rod 36 when the rod is assembled in the mold. The faces 62 and 64 form an angle of about 90°.

The ceramic rod 36 is to come and bear against the faces 62 and 64 via bearing lines that are substantially parallel to the axis of the rod.

The paste is injected into the mold and is to flow into the first imprint 42 of the mold in the direction shown by the arrow 66. The face 64 of the notch 60 is substantially perpendicular to this direction, thus making it possible to hold the rod 36 effectively in position while the paste is flowing around the rod, thereby limiting any deformation thereof.

Figure 6:
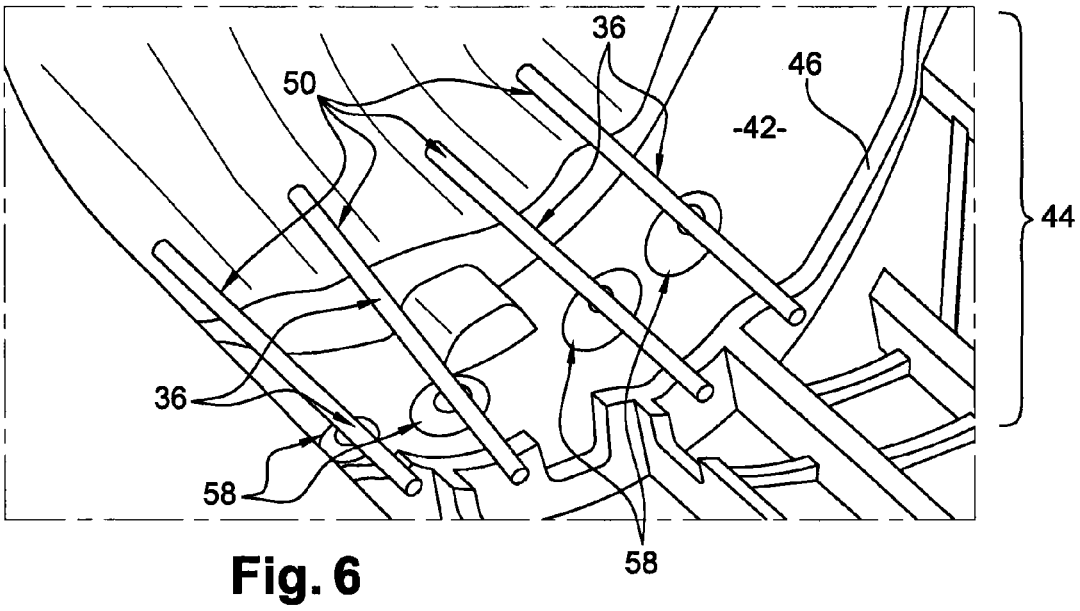
FIG. 6 is a fragmentary diagrammatic view in perspective of other tooling of the invention for fabricating a foundry core by molding, this tooling carrying four ceramic rods of the core.

FIG. 6 shows another embodiment of the invention in which the mold of the tooling includes support means 58 for supporting four ceramic rods 36, the support means being similar to those described above and being independent and spaced apart from one another.

After fabrication, the core 30 includes in its first portion 32 as many recesses as there are support means present in the mold for fabricating the core. In the embodiment of FIGS. 4 and 5, the core includes one recess, whereas in the embodiment of FIG. 6, the core includes four recesses. The recesses are complementary in shape to the shapes of the support means. The present invention provides a method including a step in which these sockets are filled in with a filler ceramic material of composition that is preferably close to the composition of the material of the core.

As mentioned above, the paste injected into the mold of FIG. 5 can exert a force on the rod 36 in a direction opposite to the direction of the arrow 66. Because of the shape of the notch 60 in the member 58, the rod is not supported by the member on the side opposite from the face 64, and it can thus move or break under the force exerted by the paste.

The embodiments described below remedy this particular drawback by a support member in which the notch for receiving the rod presents a section that is U-shaped or C-shaped.

Figure 7:
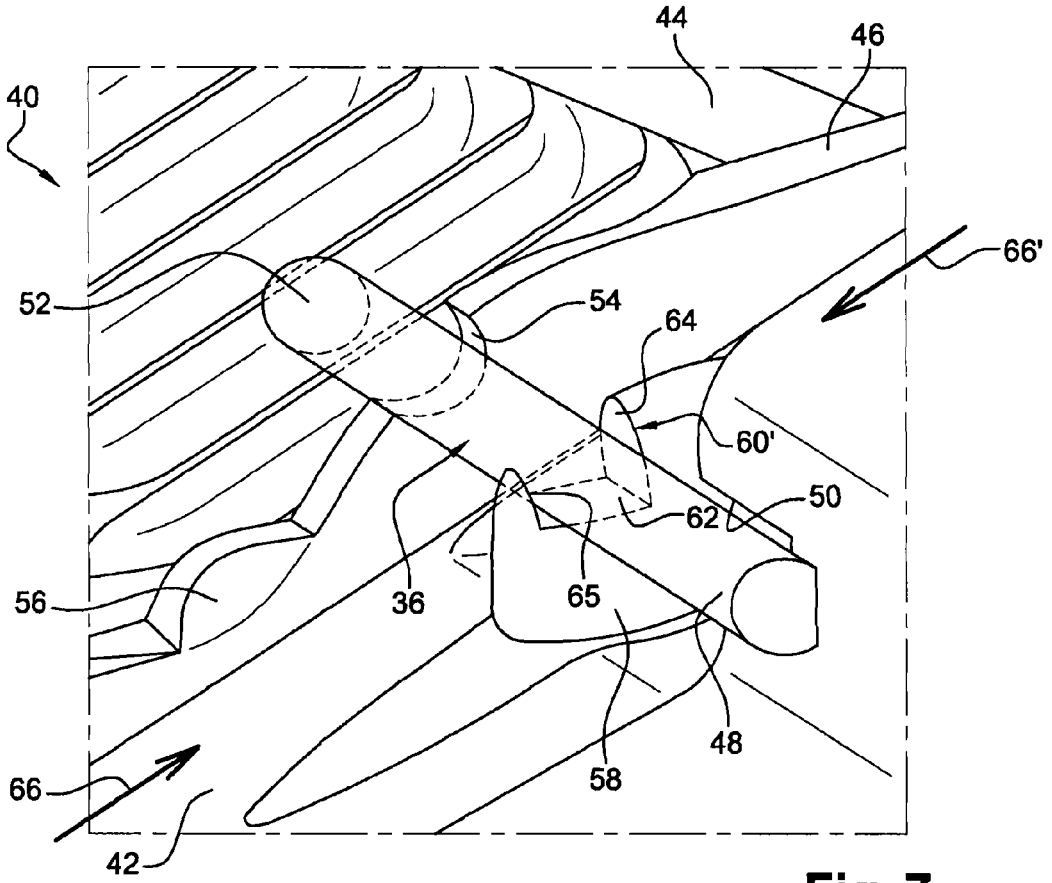
FIG. 7 is a view similar to the view of FIG. 5 and shows tooling of the invention for fabricating a foundry core by molding.

FIG. 7 shows a first embodiment in which the elements that are described above are designated by the same references.

The member 58 differs from the member shown in FIG. 5 in that its notch 60' has two side faces 64 and 65 that are substantially parallel to each other and to the longitudinal axis of the rod 36, and that have bottom ends that are connected together via a bottom face 62 of the notch.

In the assembly position shown in FIG. 7, the rod 36 is to bear against the faces 62, 64, and 65. Nevertheless, because of the manufacturing tolerances of the parts, it is possible that clearance of a few tenths or hundredths of a millimeter might exist between the rod and the faces 62, 64, and 65.

The rod 36 is thus supported on each side by the member 58 and is held in place even if the paste injected into the tooling exerts lateral forces on the rod on both sides of the rod (arrows 66 and 66').

Figure 8:
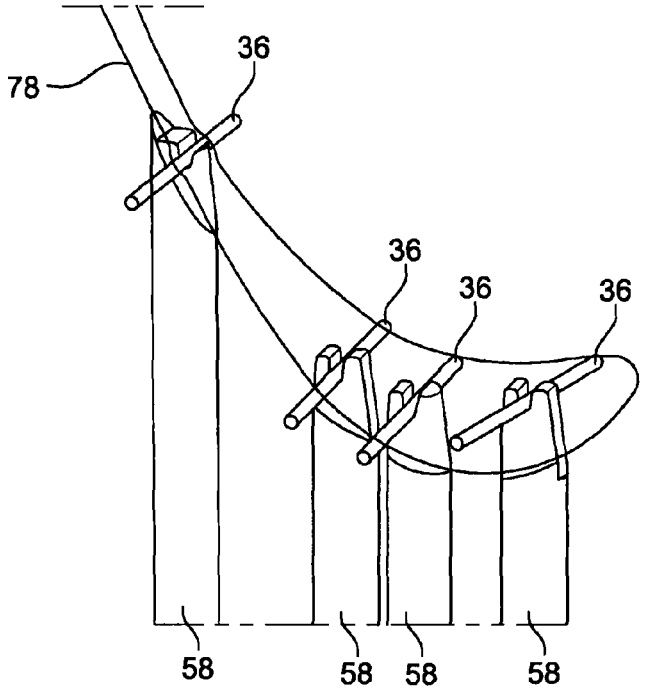
FIG. 8 is a highly diagrammatic view in perspective of support members for supporting rods in tooling of the invention, and also includes a diagrammatic cross-section view of the core to be formed in the tooling.
Figure 9:
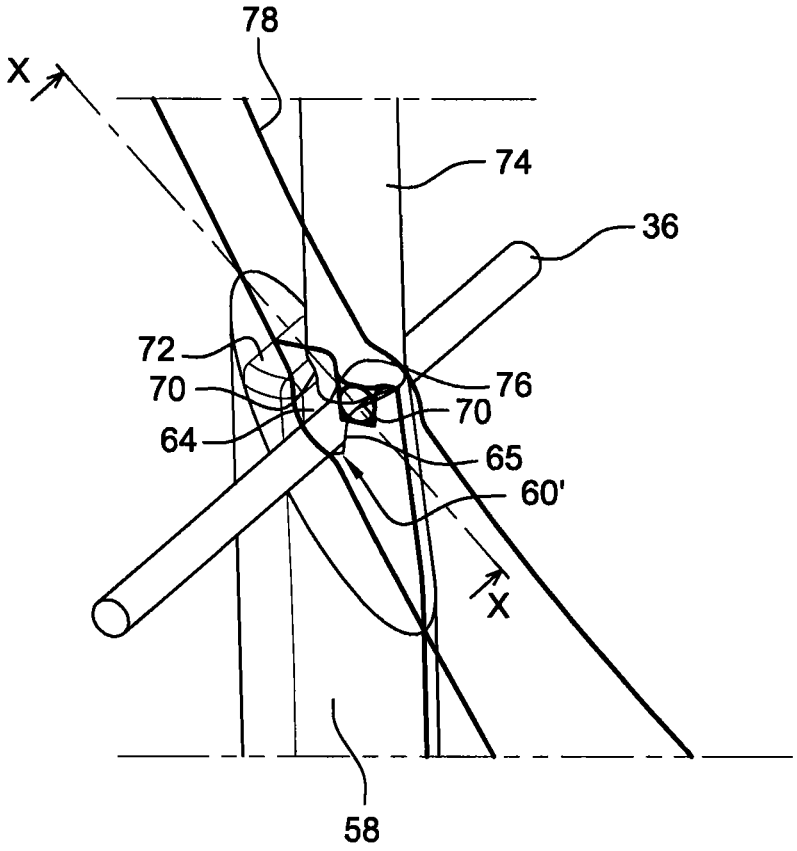
FIG. 9 is a view on a larger scale of a portion of FIG. 8 and also shows a spacer of a countermold of the tooling.
Figure 10:
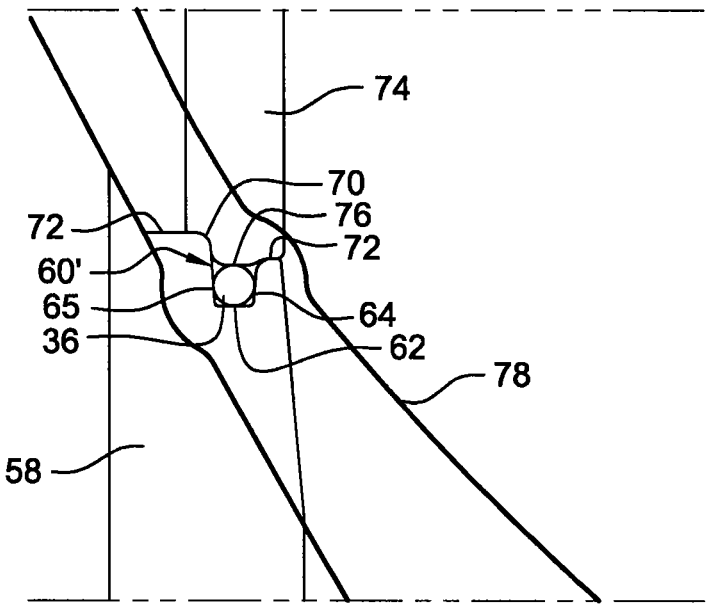
FIG. 10 is a section view on line X-X of FIG. 9.

FIGS. 8 to 10 show a variant embodiment of the invention in which the tooling has four bars 36, with their middle portions supported by support members including notches 60' of U-shaped or C-shaped section for receiving the rods.

In the example shown, the side faces 64 and 65 of the notch 60' of each member 58 are connected by convex rounded edges 70 to top faces 72 of the member (FIGS. 9 and 10). In this embodiment, the faces 64 and 65 slope a little relative to each other, the faces being spaced further apart from each other at their top ends than at their bottom ends.

The countermold (not shown) of the tooling includes a spacer 74 that projects into a imprint of the mold and that, in the assembled position, is to face one of the members 58 of the mold 40.

This spacer 74 is of elongate shape and its tip includes a finger 76 for engaging in the top portion of the notch 60' of the member 58 and for bearing against the middle portion of the rod 36.

As can be seen in FIG. 10, the tip of the spacer 74 is of a shape that is substantially complementary to the top of the member 58 and it bears against the above-mentioned top faces 72 of that member.

FIGS. 8 to 10 show diagrammatically a section 78 of the core that is to be formed. The spacer 74 of the countermold co-operates with a member 58 of the mold that is situated beside the trailing edge of the core. The spacer 74 prevents the rod 36 that is supported by the member 58 from moving and escaping from the notch in that member, since it has been found that the paste injected into the tooling can exert a force on the rod that is upwardly directed and capable of dislodging the rod from the notch in the member. The paste injected into the tooling does not exert such a force on the rods 36 supported by the other members 58, which therefore do not need to be associated with spacers 74 of the countermold.

As can be seen in the drawings, the members 58 preferably have external profiles that are rounded so as to perform a deflection and damping function on the force to which the rods 36 are subjected by the stream of paste.

The invention claimed is:

1. A tooling for fabricating a foundry core for making a cooling circuit in a turbine engine blade, the core including a first portion for defining a bathtub of the blade and a second portion for defining an internal cavity in the blade, and at least one rod that extends between the first portion and the second portion and that is to define means for passing fluid between the bathtub and the corresponding internal cavity in the blade, the tooling comprising:

a mold for injecting a paste and including imprints for the first portion and for the second portion of the core;

a support system for one end portion of the at least one rod of the core being formed in a wall of the mold between the imprint for the first portion of the core and the imprint for the second portion of the core;

a at least one support means in the imprint for the first portion of the core to support a substantially middle portion of the rod.

2. A tooling according to claim 1, wherein the core includes a plurality of rods and plurality of support means to support the substantially middle portion of each of the plurality of rods, the plurality of support means being independent of each other.

3. A tooling according to claim 1, wherein the at least one support means comprises at least one projecting member projecting from a bottom of the imprint for the first portion of the core.

4. A tooling according to claim 3, wherein a top of the at least one projecting member includes a notch for engaging the middle portion of the at least one rod.

5. A tooling according to claim 4, wherein the notch includes a section that is substantially L-shaped.

6. A tooling according to claim 5, wherein the notch includes two plane and intersecting faces that are to extend substantially parallel to a longitudinal axis of the at least one rod.

7. A tooling according to claim 4, wherein the notch includes a section that is substantially U-shaped or C-shaped.

8. A tooling according to claim 7, wherein the notch includes two plane side faces that are substantially parallel to each other and to a longitudinal axis of the at least one rod.

9. A tooling according to claim 7, wherein each of the side faces of the notch is connected to a top face of the at least one projecting member via a convex rounded edge.

10. A tooling according to claim 8, wherein one of the side faces of the notch is substantially perpendicular to a direction for injecting paste into the mold.

11. A tooling according to claim 4, further comprising a countermold that includes means for preventing the at least one rod from moving in the notch of the at least one projecting member, the means for preventing including at least one spacer formed projecting into an imprint of the countermold and including at a tip thereof a finger for at least one of engaging in a top portion of the notch and bearing against a portion of the at least one rod received in that notch.

12. A tooling according to claim 11, wherein at least one spacer includes means for bearing against and positioning the top of the at least one projecting member.

13. A tooling according to claim 11, wherein the countermold includes a number of spacers that is smaller than a number of projecting members of the mold, such that only some of the number of the projecting members of the mold are associated with spacers of the countermold.

14. A tooling according to claim 11, wherein the countermold includes only one spacer.

15. A tooling according to claim 3, wherein the at least one projecting member is formed integrally with the mold or is separate and fastened to the mold.

16. A tooling according to claim 1, further comprising a countermold that also includes support means for supporting a middle portion of the at least one rod.

17. A tooling according to claim 1, wherein the at least one support means includes at least three projecting members.

18. A tooling according to claim 17, wherein the projecting members are substantially ovoid in shape and/or have rounded external profiles configured to deflect and damp three to which the at least one rod is subjected by the stream of paste.

19. A method of fabricating a foundry core by the tooling according to claim 1, the method comprising:

injecting a paste including ceramic fillers into the tooling;

solidifying and extracting the core; and after extracting the core, filling in an indentation in the core defined by the at least one support means with a ceramic material.

* * * * *